US011056789B2

(12) United States Patent
Wu et al.

(10) Patent No.: US 11,056,789 B2
(45) Date of Patent: Jul. 6, 2021

(54) DUAL-BAND CIRCULARLY POLARIZED ANTENNA STRUCTURE

(71) Applicant: PEGATRON CORPORATION, Taipei (TW)

(72) Inventors: Chien-Yi Wu, Taipei (TW); Chao-Hsu Wu, Taipei (TW); Shih-Keng Huang, Taipei (TW); Cheng-Hsiung Wu, Taipei (TW); Yi-Ru Yang, Taipei (TW); Ching-Hsiang Ko, Taipei (TW); Sheng-Chin Hsu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 33 days.

(21) Appl. No.: 16/672,307

(22) Filed: Nov. 1, 2019

(65) Prior Publication Data

US 2020/0203835 A1 Jun. 25, 2020

(30) Foreign Application Priority Data

Dec. 20, 2018 (TW) ..... 107146271

(51) Int. Cl.

| | |
|---|---|
| ***H01Q 9/27*** | (2006.01) |
| ***H01Q 1/28*** | (2006.01) |
| ***H01Q 9/04*** | (2006.01) |
| ***H01Q 1/38*** | (2006.01) |
| ***H01Q 21/24*** | (2006.01) |
| ***H01Q 1/48*** | (2006.01) |
| ***H01Q 5/10*** | (2015.01) |

(52) U.S. Cl.

CPC ..... *H01Q 9/0407* (2013.01); *H01Q 1/38* (2013.01); *H01Q 1/48* (2013.01); *H01Q 5/10* (2015.01); *H01Q 9/27* (2013.01); *H01Q 21/24* (2013.01)

(58) Field of Classification Search

CPC ..... H01Q 9/0407; H01Q 1/38; H01Q 21/24; H01Q 1/48; H01Q 5/10; H01Q 9/27; H01Q 1/50; H01Q 5/20; H01Q 5/307

See application file for complete search history.

(56) References Cited

U.S. PATENT DOCUMENTS 5,313,216 A * 5/1994 Wang ..... H01Q 9/27 343/700 MS 5,453,752 A 9/1995 Wang et al.

(Continued)

FOREIGN PATENT DOCUMENTS

TW 200627711 8/2006

*Primary Examiner* — Vibol Tan

(74) *Attorney, Agent, or Firm* — J.C. Patents

(57) ABSTRACT

A dual-band circularly polarized antenna structure includes a microstrip line, an antenna unit and a ground. The antenna unit includes a first radiator and a second radiator. The first radiator has a feed-in portion and a first spiral pattern. The first spiral pattern spirals outwardly from a starting point close to the feed-in portion. The second radiator has a first grounding portion and a second spiral pattern. The second spiral pattern spirals outwardly from a starting point close to the first grounding portion in a manner non-overlapping with the first spiral pattern. One of the first and the second radiators has a second grounding portion. The microstrip line and the antenna unit are arranged apart. The feed-in portion of the first radiator of the antenna unit is coupled to the microstrip line. The first and the second grounding portions are coupled to the ground.

14 Claims, 17 Drawing Sheets

(56) References Cited

U.S. PATENT DOCUMENTS

| | | | | |
|---|---|---|---|---|
| 5,621,422 | A * | 4/1997 | Wang | H01Q 1/36 343/700 MS |
| 6,765,542 | B2 * | 7/2004 | McCarthy | H01Q 21/26 343/895 |
| 6,859,174 | B2 * | 2/2005 | Kane | H01Q 1/38 343/700 MS |
| 8,390,529 | B1 * | 3/2013 | Paulsen | H01Q 1/50 343/895 |
| 9,065,176 | B2 * | 6/2015 | Wang | H01Q 11/105 |
| 9,105,972 | B2 * | 8/2015 | Webb | H01Q 13/106 |
| 2015/0123869 | A1 * | 5/2015 | Bit-Babik | H01Q 19/10 343/857 |

* cited by examiner

DUAL-BAND CIRCULARLY POLARIZED ANTENNA STRUCTURE

CROSS-REFERENCE TO RELATED APPLICATION

This application claims the priority benefit of Taiwan application Ser. No. 107146271, filed on Dec. 20, 2018. The entirety of the above-mentioned patent application is hereby incorporated by reference herein and made a part of this specification.

BACKGROUND

Technical Field

The disclosure relates to an antenna structure, and more particularly to a dual-band circularly polarized antenna structure.

Description of Related Art

At present, a circularly polarized antenna generally requires a large space, and it is not easy to design an antenna performance having dual frequency bands, a broadband, and a good axial ratio. Therefore, it is a major issue today to design an antenna device having a small volume, dual frequency bands, and a good axial ratio.

SUMMARY

Technical Problem

The disclosure provides a dual-band circularly polarized antenna structure that can provide broadband dual frequency bands and can have a small volume.

A dual-band circularly polarized antenna structure of the disclosure includes a microstrip line, an antenna unit and a ground. The antenna unit is disposed on a first substrate. The antenna unit includes a first radiator and a second radiator. The first radiator has a feed-in portion and a first spiral pattern, and the first spiral pattern spirals outwardly from a starting point close to the feed-in portion. The second radiator has a first grounding portion corresponding to a position of the feed-in portion, and a second spiral pattern, and the second spiral pattern spirals outwardly from a starting point close to the first grounding portion in a manner non-overlapping with the first spiral pattern, and one of the first radiator and the second radiator further has a second grounding portion. The microstrip line is disposed on a second substrate which is disposed in parallel with the first substrate and spaced apart by a distance, and the feed-in portion of the first radiator of the antenna unit is coupled to the microstrip line. The ground is disposed on the second substrate, and the second grounding portion and the first grounding portion are coupled to the ground.

Based on the above, the antenna unit of the dual-band circularly polarized antenna structure of the disclosure form two spiral patterns by the first radiator and the second radiator spiraling outwardly around each other respectively from the portions near the feed-in portion and the first grounding portion as the two starting points, and the feed-in portion is coupled to the microstrip line below the antenna unit, such that the dual-band circularly polarized antenna structure of the disclosure can provide broadband dual frequency bands. Furthermore, the above design can allow the dual-band circularly polarized antenna structure to have a small volume.

In order to make the aforementioned features and advantages of the disclosure comprehensible, embodiments accompanied with drawings are described in detail below.

DESCRIPTION OF THE EMBODIMENTS

Figure 1:
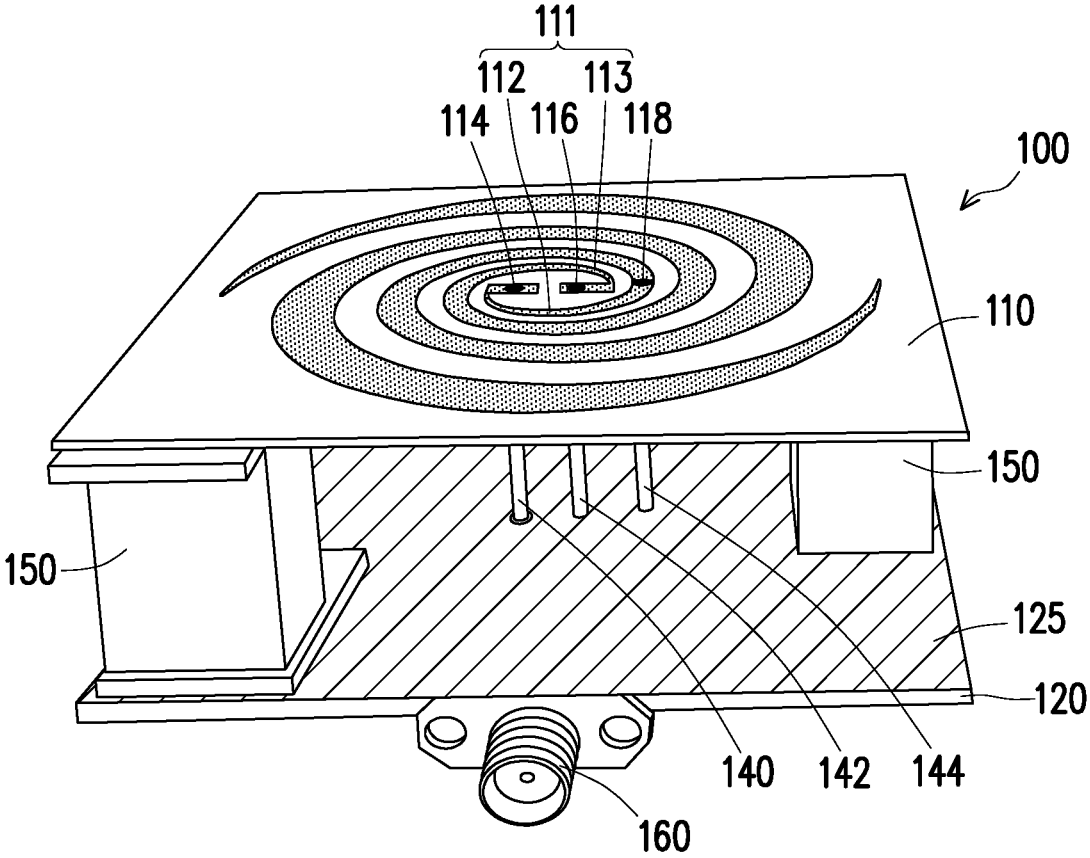
FIG. 1 is a schematic view of a dual-band circularly polarized antenna structure according to an embodiment of the disclosure.
Figure 2:
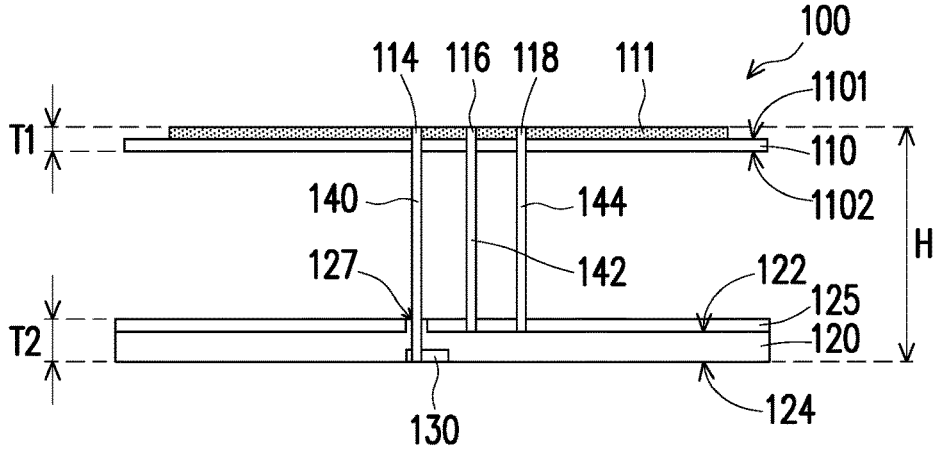
FIG. 2 is a schematic side view of the dual-band circularly polarized antenna structure of FIG. 1.
Figure 3:
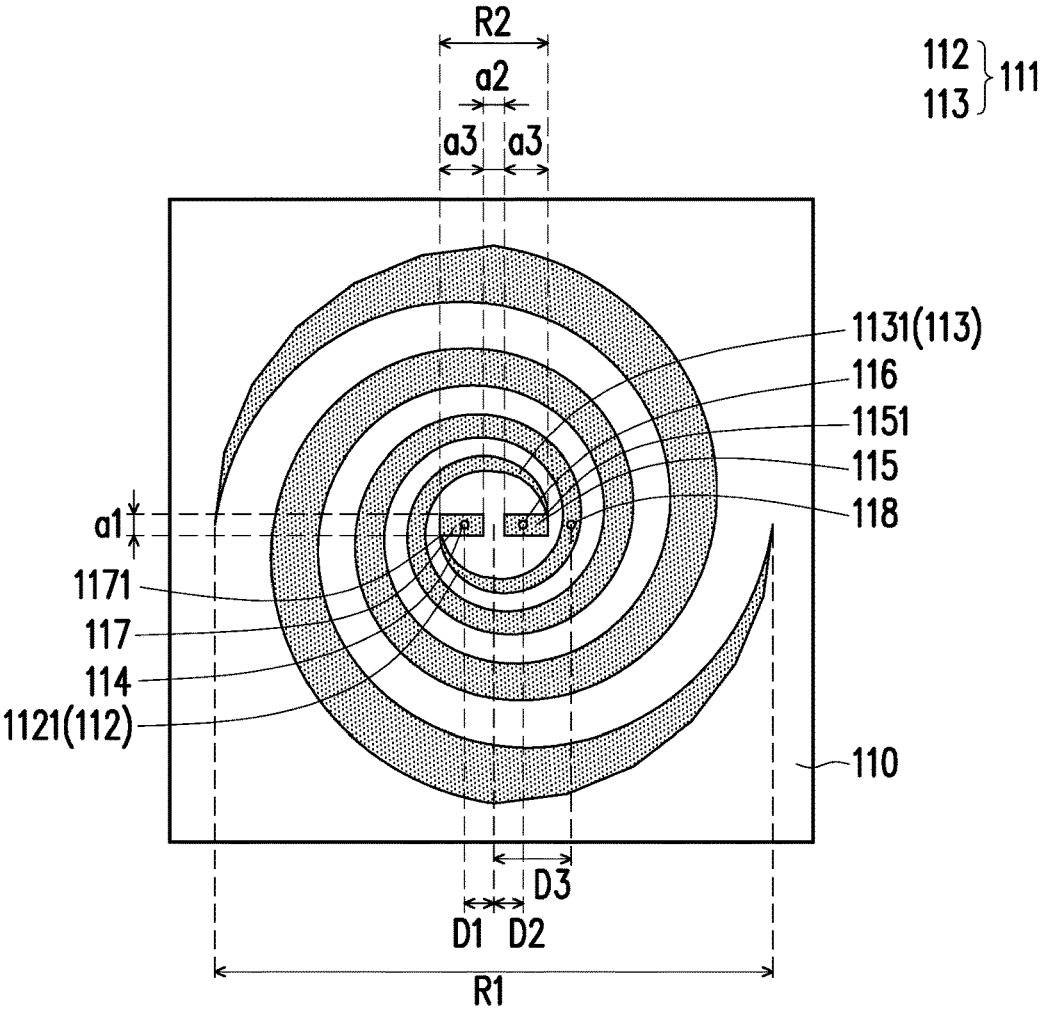
FIG. 3 is a schematic top view of a first substrate of the dual-band circularly polarized antenna structure of FIG. 1.
Figure 4:
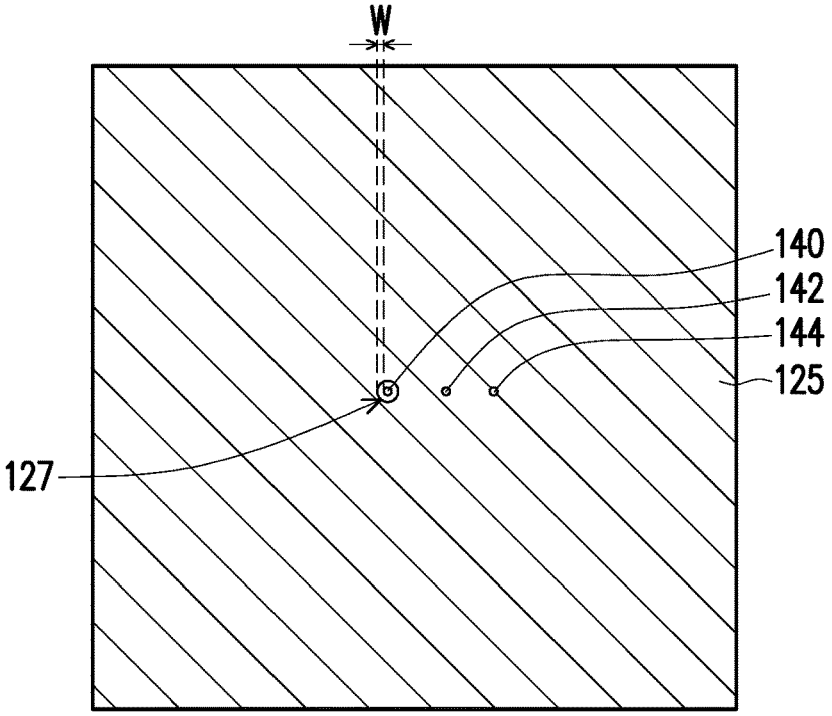
FIG. 4 is a schematic top view of a second substrate of the dual-band circularly polarized antenna structure of FIG. 1.
Figure 5:
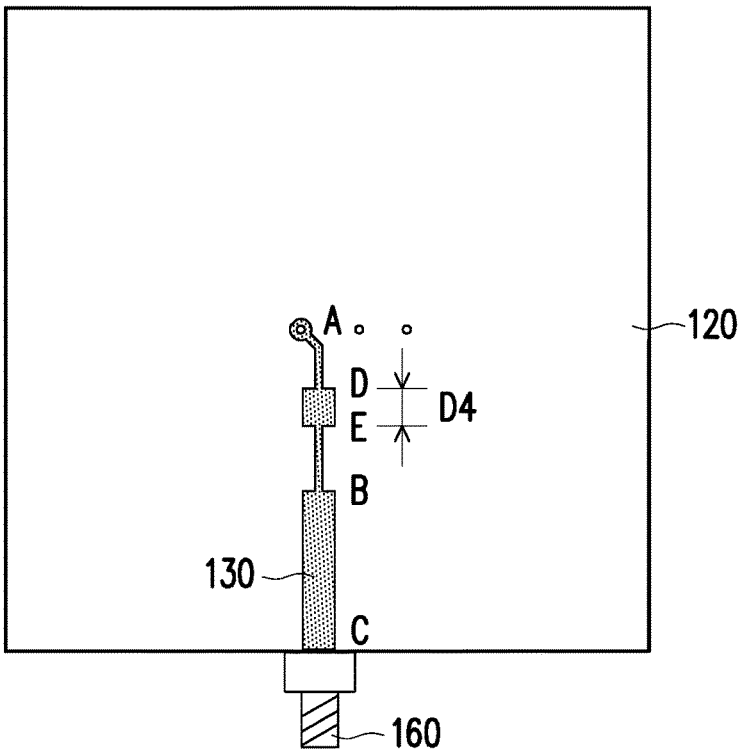
FIG. 5 is a schematic bottom view of the second substrate of the dual-band circularly polarized antenna structure of FIG. 1.

FIG. 1 is a schematic view of a dual-band circularly polarized antenna structure according to an embodiment of the disclosure. FIG. 2 is a schematic side view of the dual-band circularly polarized antenna structure of FIG. 1. FIG. 3 is a schematic top view of a first substrate of the dual-band circularly polarized antenna structure of FIG. 1. FIG. 4 is a schematic top view of a second substrate of the dual-band circularly polarized antenna structure of FIG. 1. FIG. 5 is a schematic bottom view of the second substrate of the dual-band circularly polarized antenna structure of FIG. 1.

Referring to FIG. 1 to FIG. 5, a dual-frequency circularly polarized antenna structure 100 of the embodiment is a circularly polarized antenna having dual frequency bands (for example, a low frequency is Wi-Fi 2.4 GHz, and a high frequency is Wi-Fi 5 GHz). Of course, the frequency range of the dual frequency bands is not limited to the above. The dual-band circularly polarized antenna structure 100 of the embodiment includes a microstrip line 130 (FIG. 2), an antenna unit 111, and a ground 125. As can be seen from FIG. 2, the antenna unit 111 is disposed on one side of the microstrip line 130 and spaced apart from the microstrip line 130. The ground 125 is disposed on one side of the antenna unit 111 and spaced apart from the antenna unit 111.

As can be seen from FIG. 3, in the embodiment, the antenna unit 111 includes a first radiator 112 and a second radiator 113. The first radiator 112 has a feed-in portion 114 and a first spiral pattern 1121. The first spiral pattern 1121 spirals outwardly from a starting point 1171 close to the feed-in portion 114. The second radiator 113 has a first grounding portion 116 corresponding to the position of the feed-in portion 114 and has a second spiral pattern 1131. The second spiral pattern 1131 spirals outwardly from a starting point 1151 close to the first grounding portion 116 in a manner non-overlapping with the first spiral pattern 1121. In other words, the first radiator 112 and the second radiator 113 respectively spiral outwardly around each other to form the first spiral pattern 1121 and the second spiral pattern 1131, respectively from the portions close to the feed-in portion 114 and the first grounding portion 116 as the two starting points 1171 and 1151. In addition, one of the first radiator 112 and the second radiator 113 further has a second grounding portion 118.

In addition, as shown in FIG. 2, in the embodiment, the dual-band circularly polarized antenna structure 100 further includes a first substrate 110, a second substrate 120, a first conductive pillar 140, and two second conductive pillars 142 and 144. The antenna unit 111 is disposed on an upper surface 1101 of the first substrate 110. The second substrate 120 is disposed in parallel with the first substrate 110 and spaced apart by a distance. In the embodiment, the first substrate 110 and the second substrate 120 are separated by a spacer 150 (FIG. 1) to maintain a certain distance between the first substrate 110 and the second substrate 120. The spacer 150 is, for example, a plastic support or foam, but the type of the spacer 150 is not limited thereto.

In addition, the microstrip line 130 is disposed on one of an upper surface 122 and a lower surface 124 of the second substrate 120, and the ground 125 is disposed on another of the upper surface 122 and the lower surface 124 of the second substrate 120. In the embodiment, the ground 125 is disposed on the upper surface 122 of the second substrate 120; the microstrip line 130 is disposed on the lower surface 124 of the second substrate 120; the upper surface 122 of the second substrate 120 is closer to the first substrate 110 than the lower surface 124 is (as shown in FIG. 2); however, the positions of the ground 125 and the microstrip line 130 are not limited thereto.

In the embodiment, the feed-in portion 114 is coupled to the microstrip line 130. The second grounding portion 118 and the first grounding portion 116 are coupled to the ground 125. In detail, the first conductive pillar 140 is disposed between the first substrate 110 and the second substrate 120, and the feed-in portion 114 is connected to the microstrip line 130 via the first conductive pillar 140. The two second conductive pillars 142 and 144 are disposed between the first substrate 110 and the second substrate 120, and the first grounding portion 116 and the second grounding portion 118 are connected to the ground 125 respectively via the two second conductive pillars 142 and 144. In the embodiment, the first conductive pillar 140 and the second conductive pillars 142 and 144 are, for example, copper tubular pillars having a diameter of, for example, 1 mm, but the materials and dimensions of the first conductive pillar 140 and the second conductive pillars 142 and 144 are not limited thereto.

As can be seen from FIG. 2, in the embodiment, a thickness T1 of the antenna unit 111 and the first substrate 110 in total is between 0.6 mm and 1 mm (for example, 0.8 mm). A thickness T2 of the ground 125, the microstrip line 130, and the second substrate 120 in total is between 1.2 mm and 2 mm (for example, 1.6 mm). A distance H between the antenna unit 111 on the upper surface 1101 of the first substrate 110 and the ground 125 or the microstrip line 130 on the lower surface 124 of the second substrate 120 is ¼ wavelength and is between about 18 mm and 21 mm (for example, 19.4 mm). Of course, the above dimensions are not limited thereto.

In the embodiment, a distance between the lower surface 1102 of the first substrate 110 and the upper surface 122 of the second substrate 120 is ¼ wavelength (about 17 mm) of a high frequency signal (for example, 5 GHz) generated by the antenna structure 100. In actual applications, the distance between the lower surface 1102 of the first substrate 110 and the upper surface 122 of the second substrate 120 is adjusted such that the antenna structure 100 has good performance in both the axial ratio at low frequencies and the axial ratio at high frequencies, and the distance is set to 17 mm, for example. Of course, the above dimensions are not limited thereto.

As can be seen from FIG. 3, in the embodiment, two rectangles 115 and 117 are formed from the two starting points 1171 and 1151 of the first spiral pattern 1121 and the second spiral pattern 1131 of the antenna unit 111 extending toward a center of a line connecting the two starting points 1171 and 1151 of the first spiral pattern 1121 and the second spiral pattern 1131, and the feed-in portion 114 and the first grounding portion 116 are respectively located on the two rectangles 117 and 115. In the embodiment, the second grounding portion 118 is exemplified as being formed on the first radiator 112. In the embodiment, the second grounding portion 118 is located at a position rotated from the feed-in portion 114 along the first radiator 112 by 180 degrees such that the first grounding portion 116 is located between the feed-in portion 114 and the second grounding portion 118, and the feed-in portion 114, the first grounding portion 116, and the second grounding portion 118 are arranged in a straight line. Of course, the positions of the feed-in portion 114, the first grounding portion 116, and the second grounding portion 118 are not limited thereto.

In the embodiment, a width line with a width a1 of each of the rectangles 115 and 117 is perpendicular to a line connecting the two starting points 1151 and 1171 of the first spiral pattern 1121 and the second spiral pattern 1131, and a length line with a length a3 of each of the rectangles 115 and 117 is parallel to the line connecting the two starting points 1151 and 1171 of the first spiral pattern 1121 and the second spiral pattern 1131. The width al of each of the rectangles 115 and 117 is between 1.5 mm and 2.5 mm (for example, 2 mm), and the length a3 of each of the rectangles 115 and 117 is between 3.5 mm and 5 mm (for example, 4 mm), and a distance a2 between the two rectangles 115 and 117 is between 1.5 mm and 2.5 mm (for example, 2 mm). In the embodiment, by changing the width al and the length a3 of each of the rectangles 115 and 117 or the distance a2 between the two rectangles 115 and 117, the antenna frequency and impedance matching at low and high frequencies of the dual-band circularly polarized antenna structure 100 may be adjusted.

In addition, as can be seen from FIG. 3, in the embodiment, a distance D1 between a center of a line connecting the two starting points 1171 and 1151 of the first spiral pattern 1121 and the second spiral pattern 1131, and the feed-in portion 114 is between 2 mm to 3 mm (for example, 2.5 mm). A distance D2 between the center of the line connecting the two starting points 1171 and 1151 of the first spiral pattern 1121 and the second spiral pattern 1131, and the first grounding portion 116 is between 2 mm and 3 mm (for example, 2.5 mm). A distance D3 between the center of the line connecting the two starting points 1171 and 1151 of the first spiral pattern 1121 and the second spiral pattern 1131, and the second grounding portion 118 is between 6 mm and 8 mm (for example, 7 mm).

In addition, in the embodiment, a distance R2 between the two starting points 1171 and 1151 of the first spiral pattern 1121 and the second spiral pattern 1131 is between 8.5 mm and 12.5 mm (for example, 10.5 mm). A diameter R1 of each of the first spiral pattern 1121 and the second spiral pattern 1131 (i.e., a distance between two end points) is between 50 mm and 55 mm (for example, 52.5 mm). The diameter R1 may determine the resonance frequency at low frequencies of the antenna structure 100, and the distance R2 may determine the resonance frequency at high frequencies of the antenna structure 100. Of course, the above dimensions are not limited thereto.

Referring to FIG. 2 and FIG. 4, in the embodiment, the ground 125 is located between the antenna unit 111 and the microstrip line 130. The ground 125 has a hole 127 and may fill the upper surface 122 of the second substrate 120 except the hole 127. The first conductive pillar 140 passes through the second substrate 120, and the portion of the first conductive pillar 140 on the upper surface 122 of the second substrate 120 is located in the hole 127 such that the first conductive pillar 140 is not conductive to the ground 125. In the embodiment, a minimum distance W between the first conductive pillar 140 and an edge of the hole 127 is between 0.5 mm and 1.5 mm (for example, 1 mm). The size of the minimum distance W between the first conductive pillar 140 and the edge of the hole 127 may improve the impedance matching at high frequencies of the dual-band circularly polarized antenna structure 100.

In addition, referring to FIG. 5, in the embodiment, the dual-band circularly polarized antenna structure 100 further includes an antenna signal connector 160 disposed on an edge of the second substrate 120. One end A of the microstrip line 130 is connected to the first conductive pillar 140 and another end C of the microstrip line 130 is connected to the antenna signal connector 160. The feed-in portion 114 of the antenna unit 111 is connected to the signal positive terminal of the antenna signal connector 160 (for example, an SMA connector) through the first conductive pillar 140 and the microstrip line 130. The first grounding portion 116 and the second grounding portion 118 of the antenna unit 111 are connected to the signal negative terminal of the antenna signal connector 160 respectively through the second conductive pillars 142 and 144 and the ground 125.

In addition, as can be seen from FIG. 5, the microstrip line 130 includes a first segment (the AD segment), a second segment (the DE segment), a third segment (the EB segment), and a fourth segment (the BC segment) from the first conductive pillar 140 to the antenna signal connector 160. A width of the second segment (the DE segment) and the fourth segment (the BC segment) is greater than a width of the first segment (the AD segment) and the third segment (the EB segment), and a length D4 of the second segment (the DE segment) is between 3 mm and 4 mm (for example, 3.5 mm), such that a better impedance matching is achieved.

In the embodiment, a radio frequency (RF) transmission signal feeds into the microstrip line 130 through the antenna signal connector 160, and the length of the microstrip line 130 in the fourth segment (the BC segment) is calculated as ¼ wavelength of a high frequency signal, and is about 15 mm, and the width of the BC segment is 3 mm.

In the embodiment, calculated by the impedance matching conversion formula, the length of the AB segment is ¼ wavelength of the high-frequency signal, i.e., 15 mm, and the width of the AB segment is 0.7 mm. In the embodiment, in the center of the AB segment of the microstrip line 130, i.e., between the first segment (the AD segment) and the third segment (the EB segment), a rectangle having a length and a width respectively of 3.5 mm and 3 mm is disposed as the second segment (the DE segment) and may be used to adjust the impedance matching of the antenna frequency band of the dual-band circularly polarized antenna structure 100.

In the embodiment, the dual-band circularly polarized antenna structure 100 forms the first spiral pattern 1121 and the second spiral pattern 1131 by the first radiator 112 and the second radiator 113 spiraling around each other respectively, and combines the structure of the microstrip line 130 to form a small circularly polarized antenna with dual frequency bands (Wi-Fi 2.4 GHz and Wi-Fi 5 GHz). The overall volume of the dual-band circularly polarized antenna structure 100 may be a combination of length, width and height respectively of 60 mm, 60 mm and 19.4 mm. Due to its small volume, it is suitable for application in the factory test end or in the research and development end as a test fixture to test products to be tested. The dual-band circularly polarized antenna structure 100 may be applied in near-field wireless performance tests in the factory RF end, and may simultaneously have transmission or reception strength in co-polarization and cross-polarization directions for the products to be tested.

Dual-band circularly polarized antenna structures of other embodiments will be described below. The same or similar elements as those of the previous embodiment are denoted by the same or similar reference numerals, and descriptions thereof will be omitted. Only the main differences will be described below.

Figure 6:
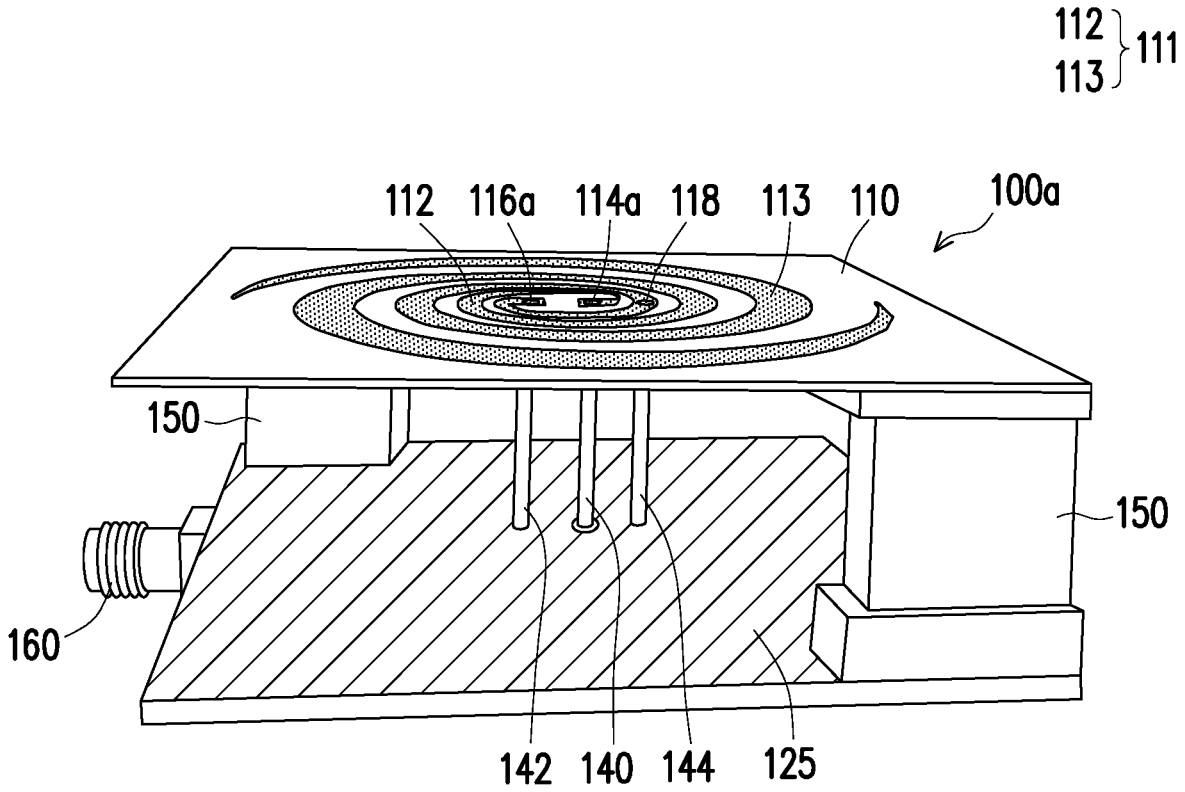
FIG. 6 is a schematic view of a dual-band circularly polarized antenna structure according to another embodiment of the disclosure.

FIG. 6 is a schematic view of a dual-band circularly polarized antenna structure according to another embodiment of the disclosure. Referring to FIG. 6, the dual-band circularly polarized antenna structure **100*a* of FIG. 6 is different from the dual-band circularly polarized antenna structure 100 of FIG. 1 in that, in FIG. 1, the second grounding portion 118 is formed on the first radiator 112, such that the first grounding portion 116 is located between the feed-in portion 114 and the second grounding portion 118, and the direction of the line connecting the feed-in portion 114 and the first grounding portion 116 is perpendicular to the extending direction of the microstrip line 130. In contrast, in the embodiment, the second grounding portion 118 is formed on the second radiator 113, such that the feed-in portion 114***a* is located between the first grounding portion 116*a* and the second grounding portion 118, and the direction of the line connecting the feed-in portion 114*a* and the first grounding portion 116*a* is parallel to the extending direction of the microstrip line 130.

Figure 7:
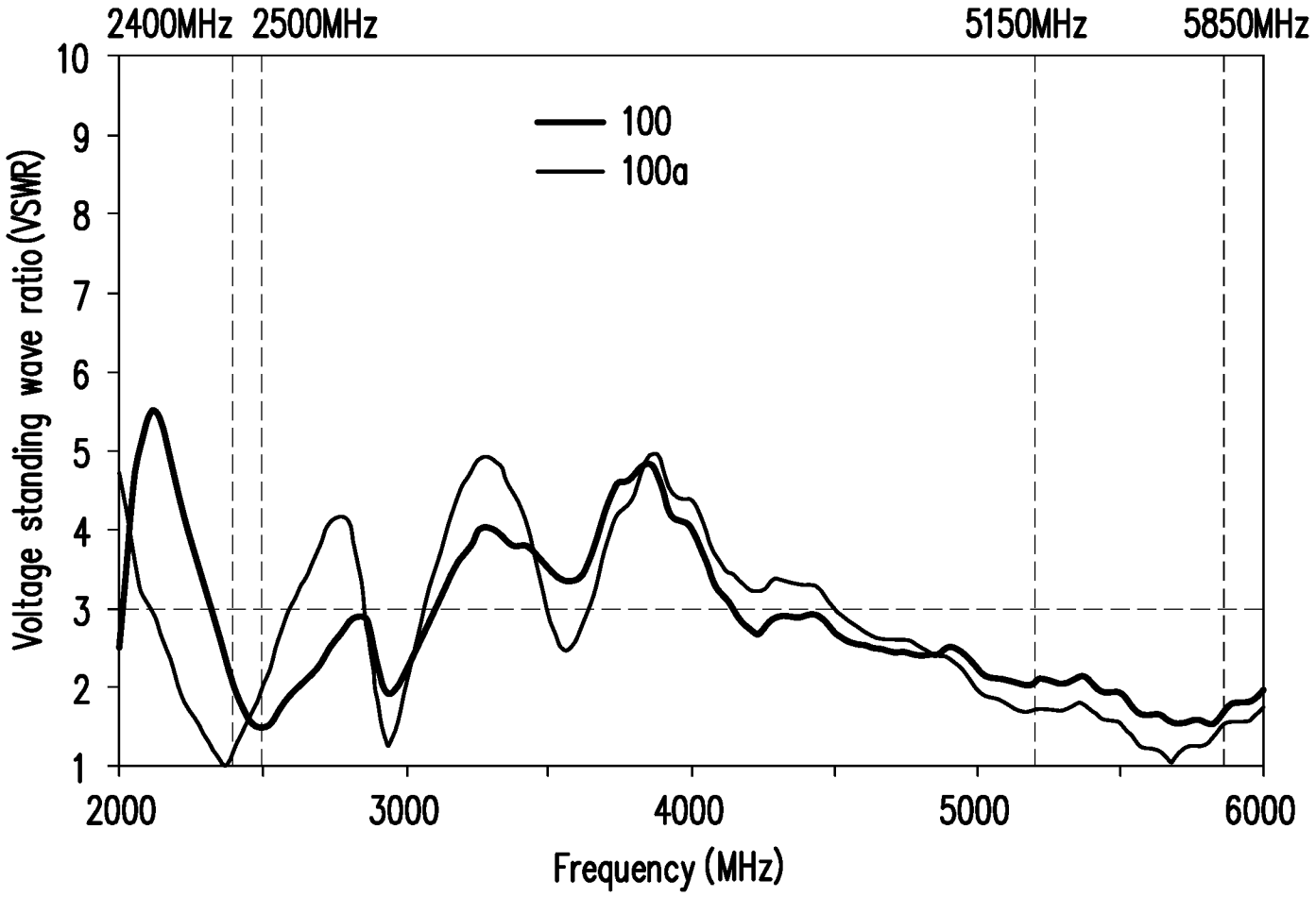
FIG. 7 is a frequency-voltage standing wave ratio schematic diagram of the dual-band circularly polarized antenna structures of FIG. 1 and FIG. 6.

FIG. 7 is a frequency-voltage standing wave ratio schematic diagram of the dual-band circularly polarized antenna structures of FIG. 1 and FIG. 6. Referring to FIG. 7, each of the dual-band circularly polarized antenna structure 100 of FIG. 1 and the dual-band circularly polarized antenna structure 100*a* of FIG. 6 can have a voltage standing wave ratio VSWR less than or equal to 3 at frequency bands of a low frequency (i.e., 2.4 GHz) and a high frequency (i.e., 5 GHz), and thus have good performance.

Figure 8:
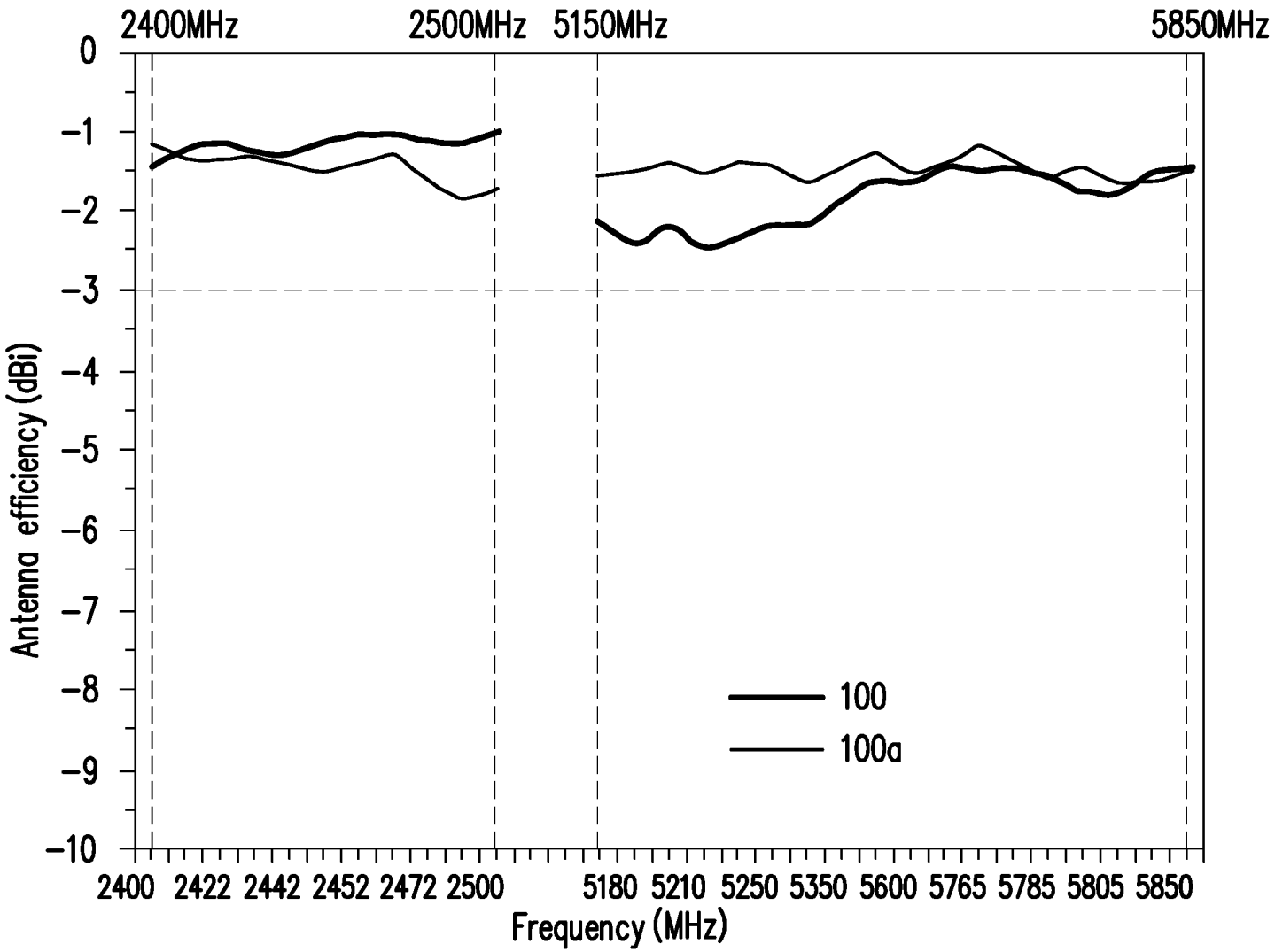
FIG. 8 is a frequency-antenna efficiency schematic diagram of the dual-band circularly polarized antenna structures of FIG. 1 and FIG. 6.

FIG. 8 is a frequency-antenna efficiency schematic diagram of the dual-band circularly polarized antenna structures of FIG. 1 and FIG. 6. Referring to FIG. 8, the dual-band circularly polarized antenna structure 100 of FIG. 1 and the dual-band circularly polarized antenna structure 100*a* of FIG. 6 can have an antenna efficiency greater than −3 dBi, or even greater than −2.5 dBi, at frequency bands of a low frequency (i.e., 2.4 GHz) and a high frequency (i.e., 5 GHz), and thus have good performance.

Figure 9:
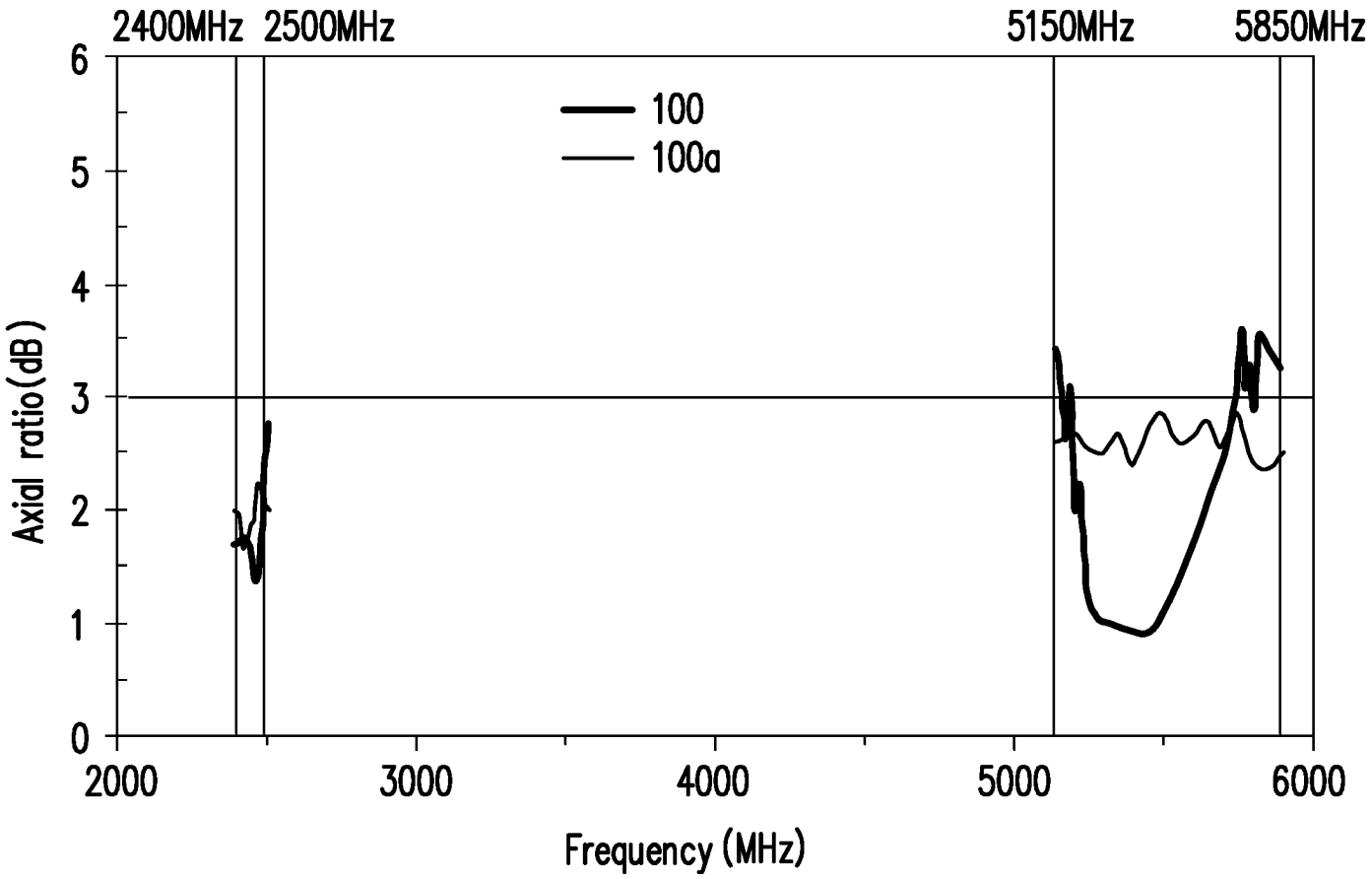
FIG. 9 is a frequency-axial ratio schematic diagram of the dual-band circularly polarized antenna structures of FIG. 1 and FIG. 6.

FIG. 9 is a frequency-axial ratio schematic diagram of the dual-band circularly polarized antenna structures of FIG. 1 and FIG. 6. Referring to FIG. 9, the dual-band circularly polarized antenna structure 100 of FIG. 1 and the dual-band circularly polarized antenna structure 100*a* of FIG. 6 have an axial ratio substantially less than 3 dB (in particular, the dual-band circularly polarized antenna structure 100*a* of FIG. 6 has an axial ratio constantly less than 3 dB) at frequency bands of a low frequency (i.e., 2.4 GHz) and a high frequency (i.e., 5 GHz), and thus have good performance.

Figure 10:
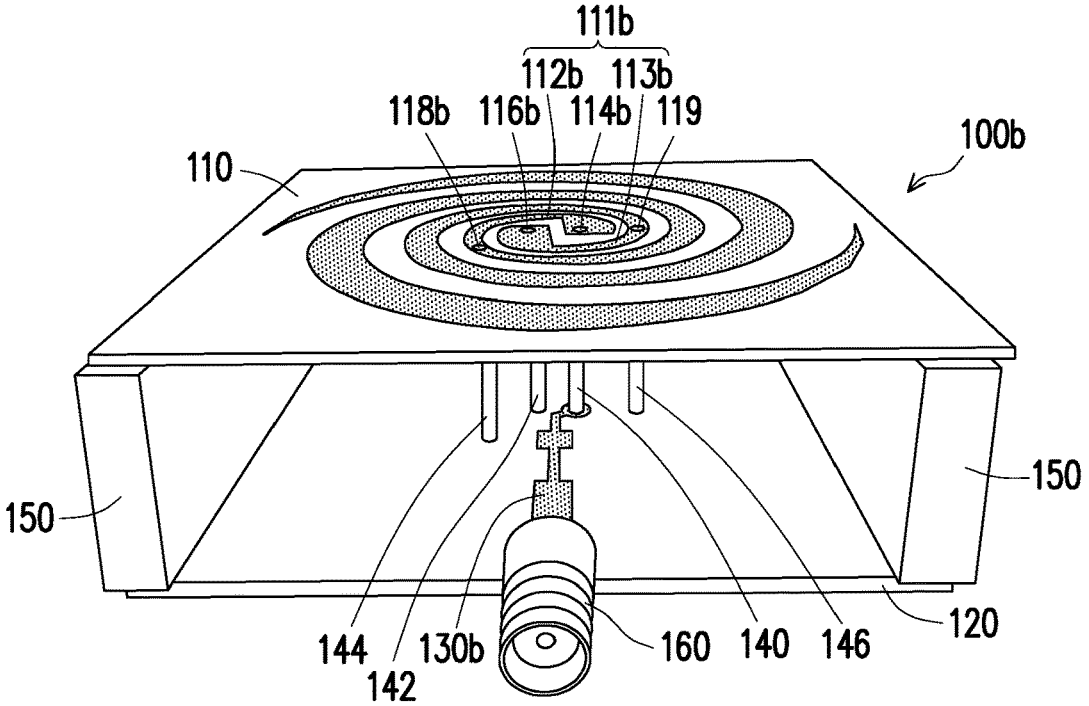
FIG. 10 is a schematic view of a dual-band circularly polarized antenna structure according to another embodiment of the disclosure.
Figure 11:
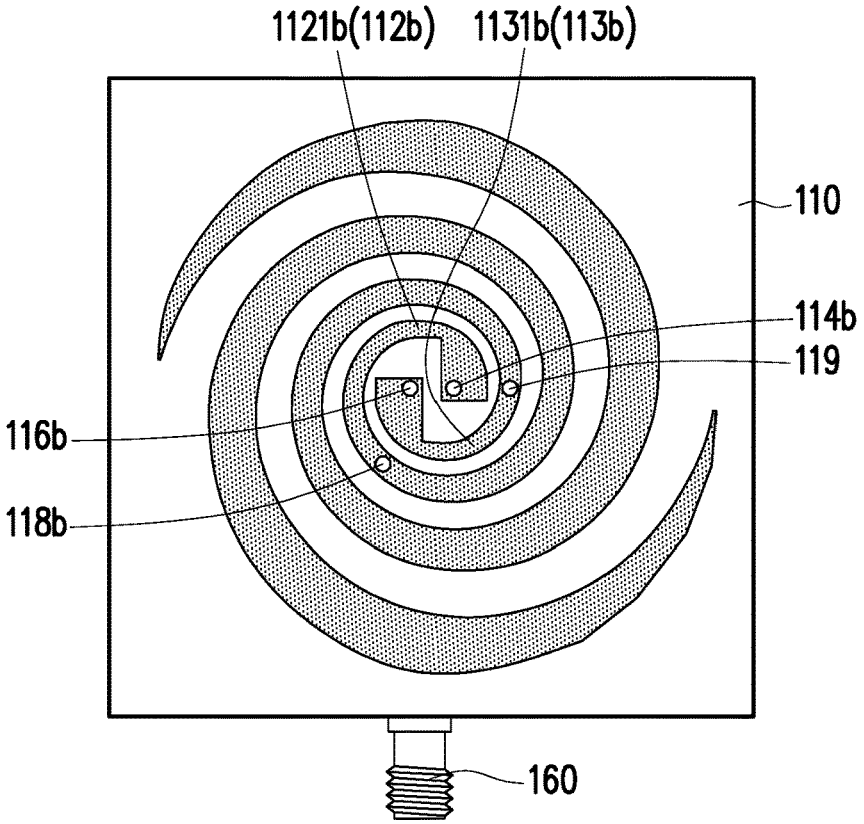
FIG. 11 is a schematic top view of a first substrate of the dual-band circularly polarized antenna structure of FIG. 10.
Figure 12:
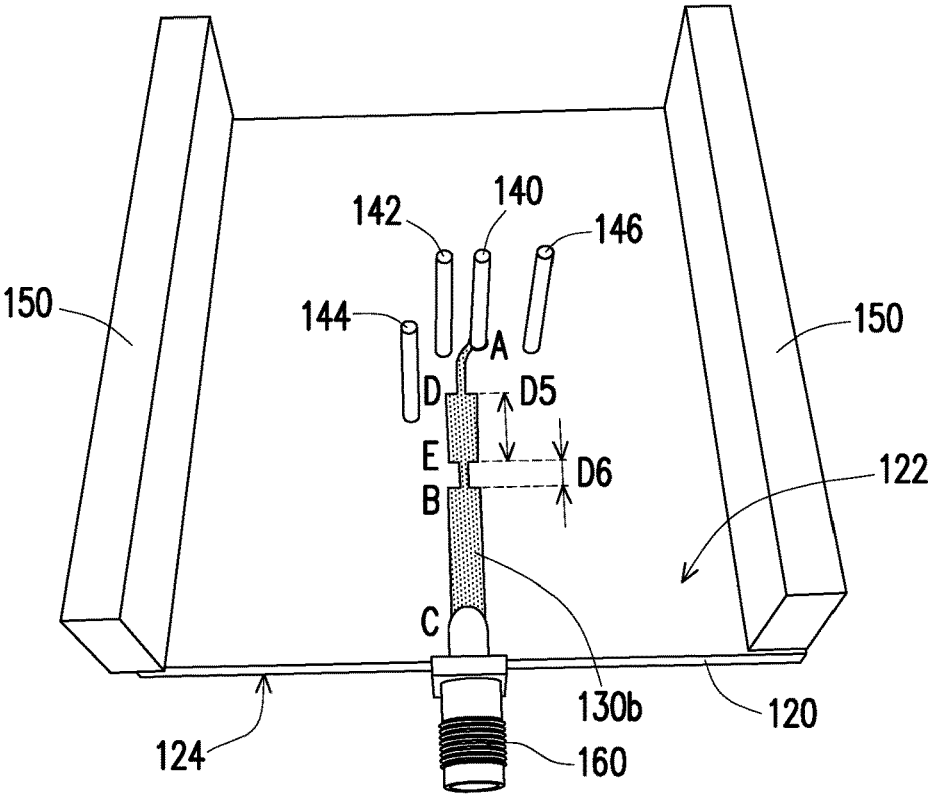
FIG. 12 is a schematic top view of a second substrate of the dual-band circularly polarized antenna structure of FIG. 10.
Figure 13:
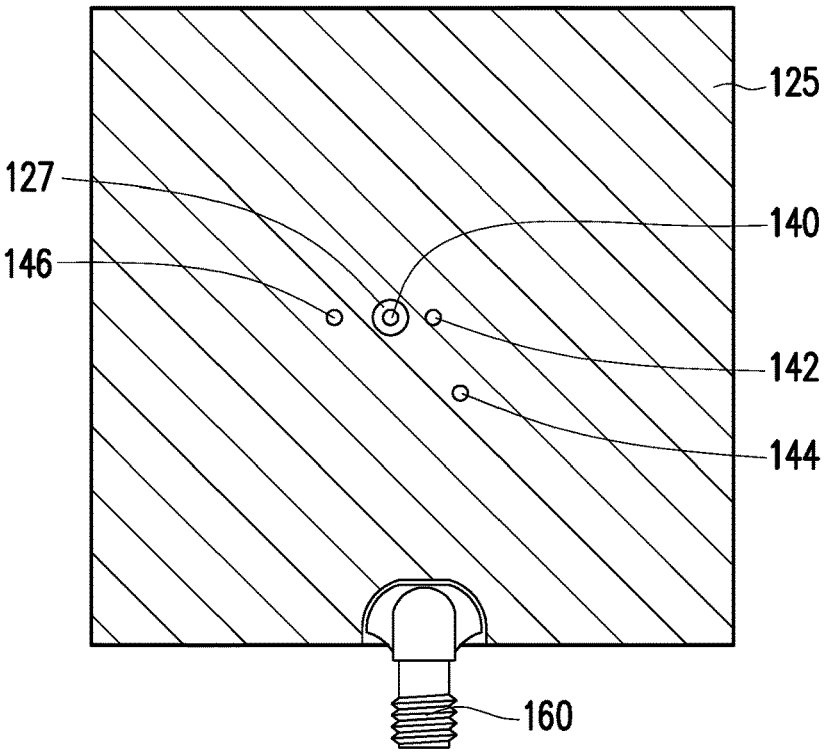
FIG. 13 is a schematic bottom view of the second substrate of the dual-band circularly polarized antenna structure of FIG. 10.

FIG. 10 is a schematic view of a dual-band circularly polarized antenna structure according to another embodiment of the disclosure. FIG. 11 is a schematic top view of a first substrate of the dual-band circularly polarized antenna structure of FIG. 10. FIG. 12 is a schematic top view of a second substrate of the dual-band circularly polarized antenna structure of FIG. 10. FIG. 13 is a schematic bottom view of the second substrate of the dual-band circularly polarized antenna structure of FIG. 10.

Referring to FIG. 10 to FIG. 13, in the embodiment, the microstrip line 130*b* of the dual-band circularly polarized antenna structure 100*b* is located between the antenna unit 111*b* and the ground 125 (FIG. 13). That is, in the embodiment, the microstrip line 130*b* is located on the upper surface 122 of the second substrate 120 (FIG. 12), and the ground 125 is located on the lower surface 124 of the second substrate 120 (FIG. 12). In the embodiment, since the microstrip line 130*b* and the antenna unit 111*b* are both disposed above the ground 125, the antenna radiation energy can be concentrated, and the back energy radiation below the ground 125 can be reduced.

In addition, as can be seen from FIG. 11, in the embodiment, the second grounding portion 118*b* is located at a position rotated from the feed-in portion 114*b* along the first radiator 112*b* by 260 degrees. In the embodiment, the second radiator 113*b* further has a third grounding portion 119. The third grounding portion 119 is coupled to the ground 125 through the second conductive pillar 146, and the third grounding portion 119 is located at a position rotated from the first grounding portion 116*b* along the second radiator 113 by 180 degrees. In the embodiment, the configurations of the feed-in portion 114*b*, the first grounding portion 116*b*, the second grounding portion 118*b*, and the third grounding portion 119 can allow the dual-band circularly polarized antenna structure 100*b* to have a better axial ratio characteristic.

In the embodiment, the shape of the first spiral pattern 1121*b* and the second spiral pattern 1131*b* of the antenna unit 111*b* near the center point is close to a ¼ circle (that is, a circular sector shape), and the feed-in portion 114*b* and the first grounding portion 116*b* are respectively located within the two ¼ circles. Of course, the shape of the first spiral pattern 1121*b* and the second spiral pattern 1131*b* of the antenna unit 111*b* near the center point is not limited thereto.

Further, as shown in FIG. 12, in the embodiment, a length D5 of the second segment (the DE segment) of the microstrip line 130*b* is between 7 mm and 9 mm (for example, 8 mm), and the width is about 3 mm. A length D6 of the third segment (the EB segment) is between 2 mm and 4 mm (for example, 3 mm). Such dimensions may improve the axial ratio characteristic on the YZ plane at high frequencies, and improve the antenna efficiency of the dual-band circularly polarized antenna structure 100*b* at high frequencies.

Figure 14:
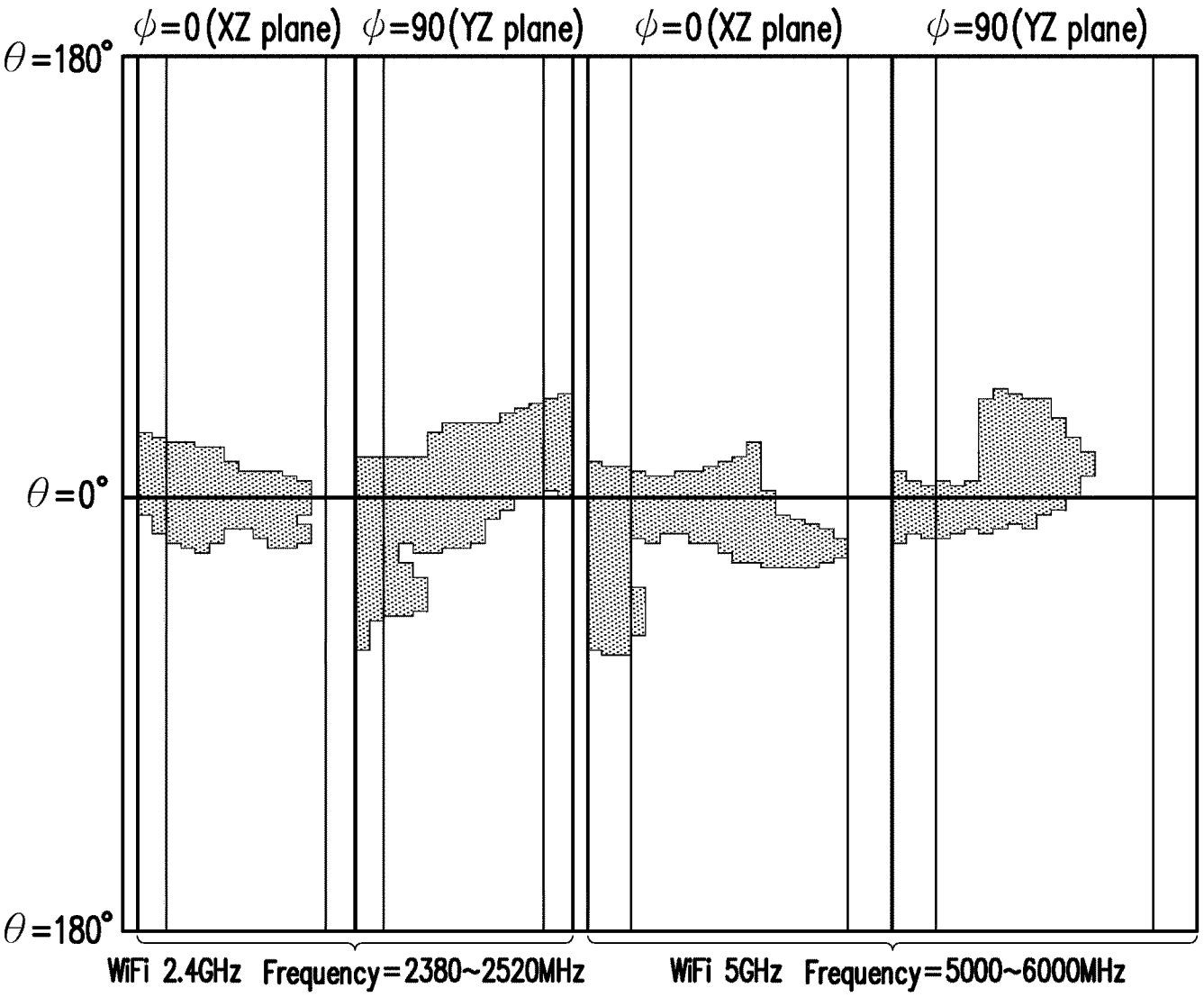
FIG. 14 is a frequency-axial ratio pattern distribution schematic diagram of the dual-band circularly polarized antenna structure of FIG. 10.

FIG. 14 is a frequency-axial ratio pattern distribution schematic diagram of the dual-band circularly polarized antenna structure of FIG. 10. It should be noted that in FIG. 14, only the area where the axial ratio is less than 3 dB is shown, and the area where the axial ratio is less than 3 dB is indicated by the dotted area. Referring to FIG. 14, the dual-band circularly polarized antenna structure 100*b* of the embodiment, at frequency bands of a low frequency (i.e., 2.4 GHz) and a high frequency (i.e., 5 GHz), has an axial ratio on the XZ plane and on the YZ plane of less than 3 dB where θ is 0 (that is, the Z-direction, directly above the dual-band circularly polarized antenna structure 100*b*), and thus has good performance.

Figure 15:
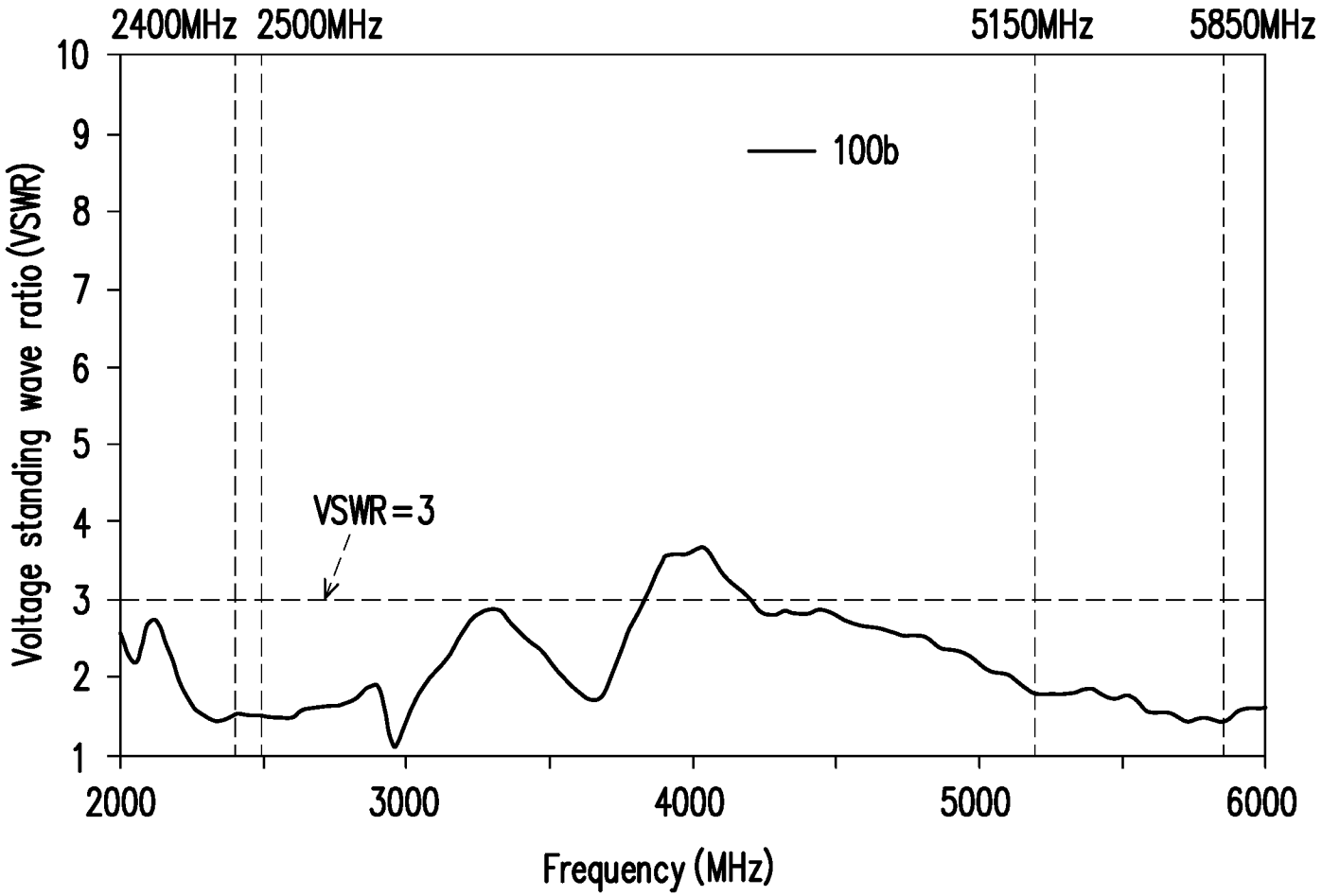
FIG. 15 is a frequency-voltage standing wave ratio schematic diagram of the dual-band circularly polarized antenna structure of FIG. 10.

FIG. 15 is a frequency-voltage standing wave ratio schematic diagram of the dual-band circularly polarized antenna structure of FIG. 10. Referring to FIG. 15, the dual-band circularly polarized antenna structure 100*b* of the embodiment has a voltage standing wave ratio VSWR less than or equal to 3 at frequency bands of a low frequency (i.e., 2.4 GHz) and a high frequency (i.e., 5 GHz), and thus has good performance.

Figure 16:
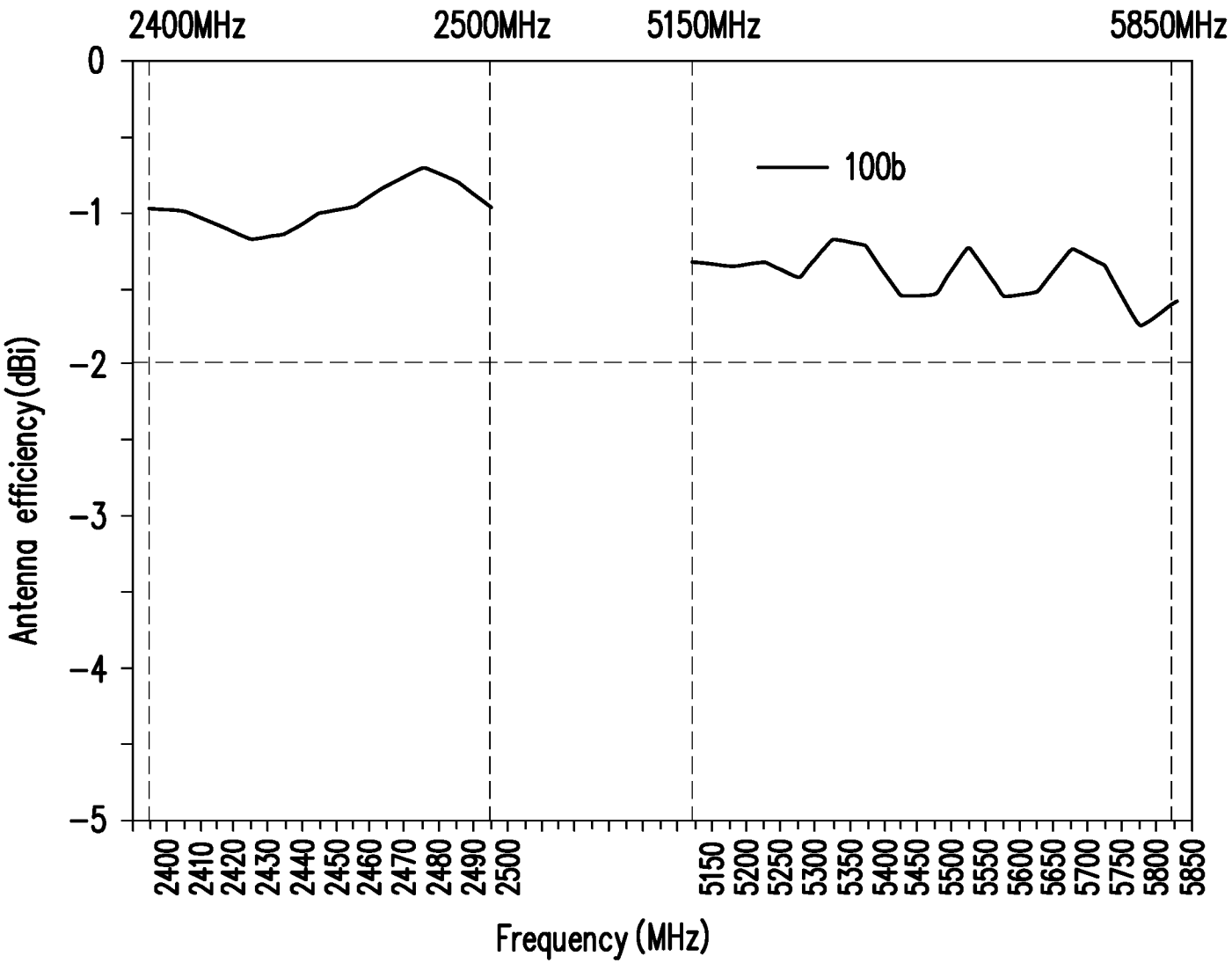
FIG. 16 is a frequency-antenna efficiency schematic diagram of the dual-band circularly polarized antenna structure of FIG. 10.

FIG. 16 is a frequency-antenna efficiency schematic diagram of the dual-band circularly polarized antenna structure of FIG. 10. Referring to FIG. 16, the dual-band circularly polarized antenna structure 100*b* of the embodiment can have an antenna efficiency constantly greater than −3 dBi, or even greater than −2 dBi, at frequency bands of a low frequency (i.e., 2.4 GHz) and a high frequency (i.e., 5 GHz), and thus has good performance.

Figure 17B:
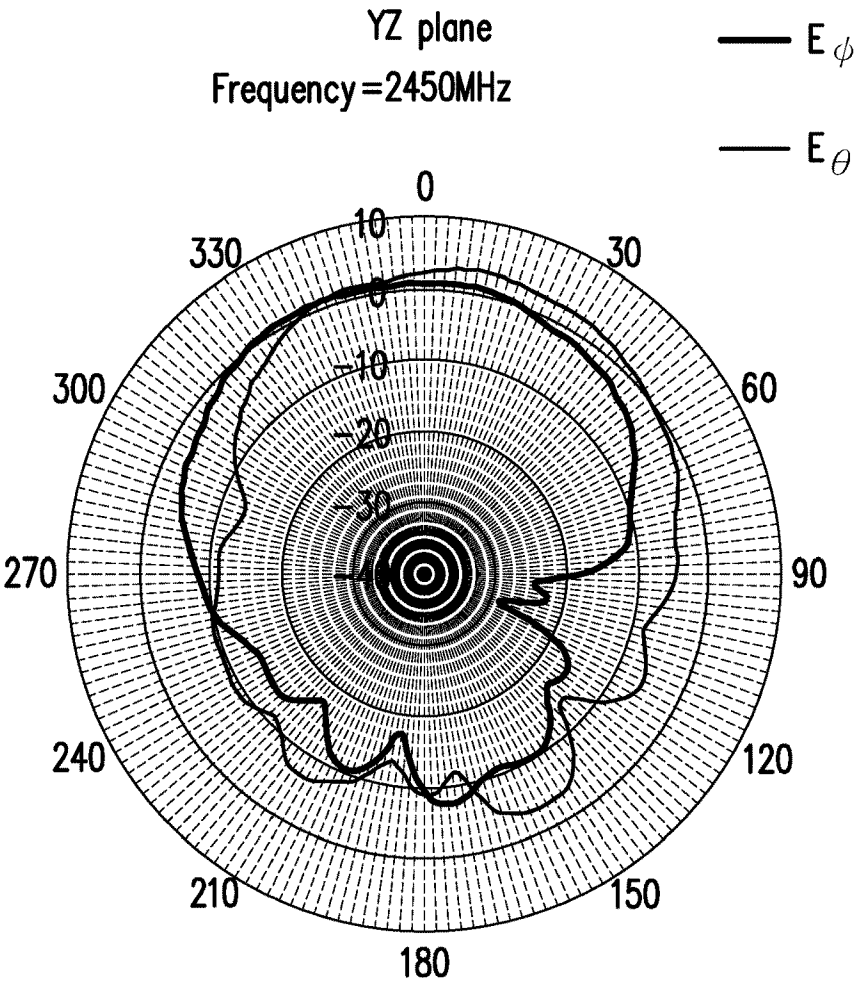
FIG. 17A and FIG. 17B are $E_\Psi$ and $E_\theta$ pattern diagrams of the XZ plane and the YZ plane of the dual-band circularly polarized antenna structure of FIG. 10 at a frequency of 2450 MHz.
Figure 17A:
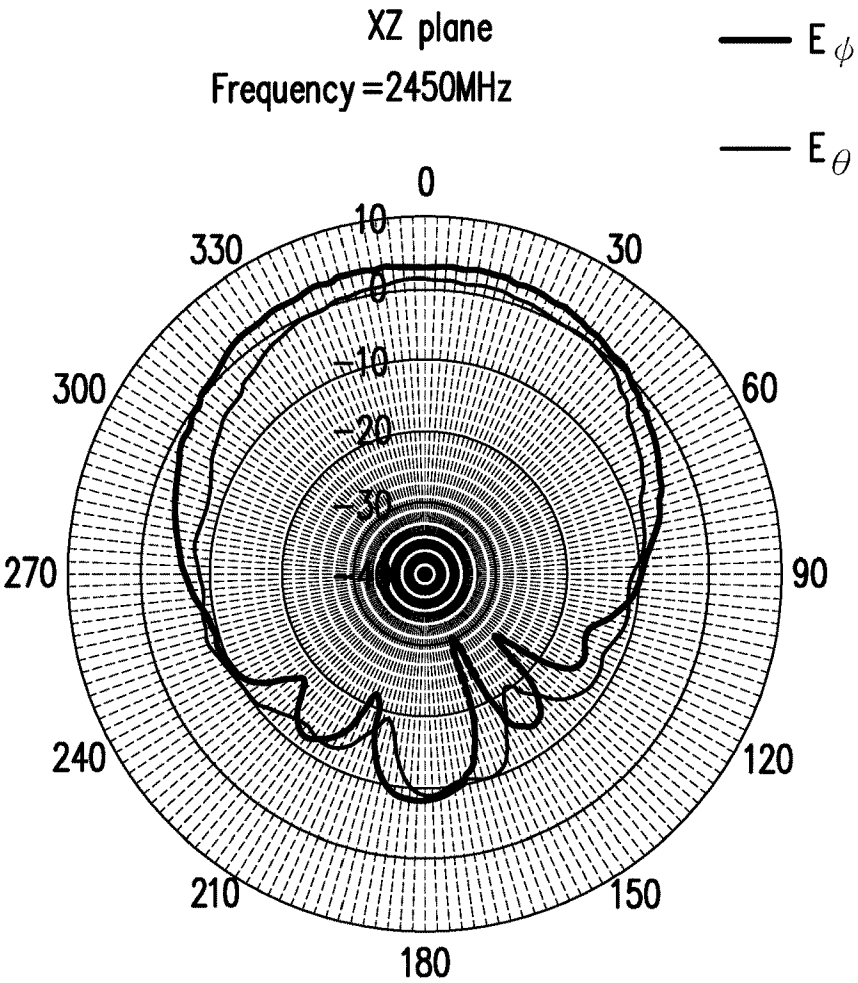
Figure 17D:
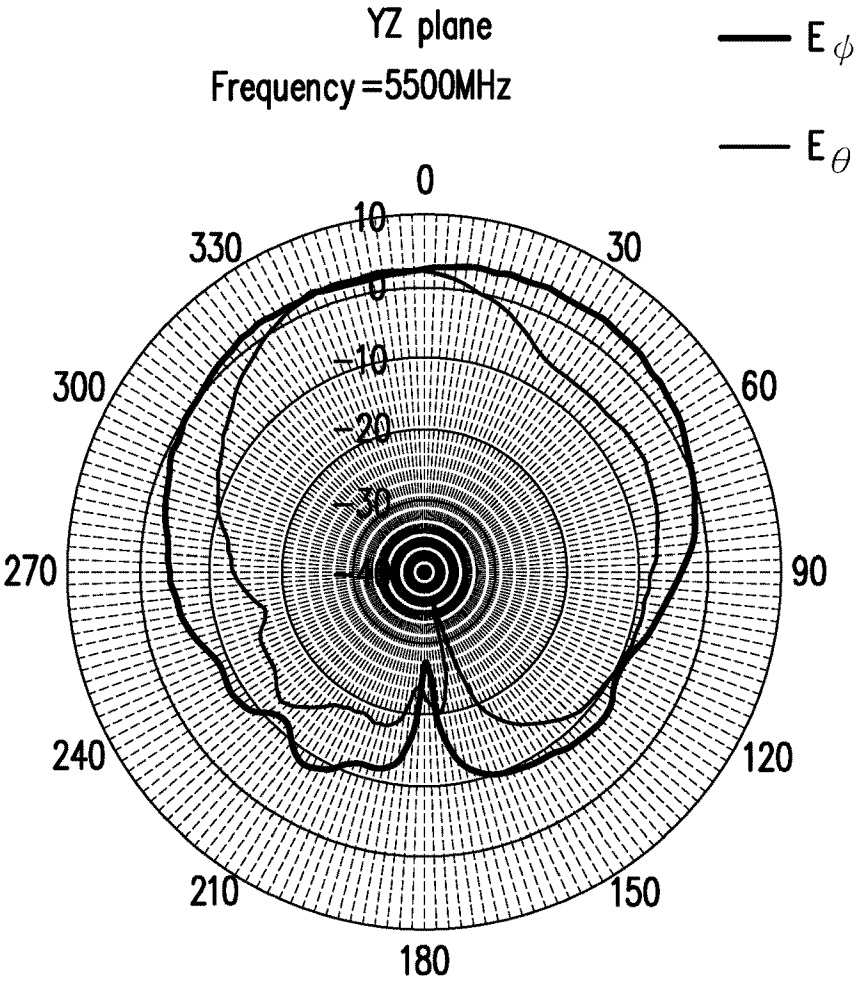
FIG. 17C and FIG. 17D are $E_\Psi$ and $E_\theta$ pattern diagrams of the XZ plane and the YZ plane of the dual-band circularly polarized antenna structure of FIG. 10 at a frequency of 5500 MHz.
Figure 17C:
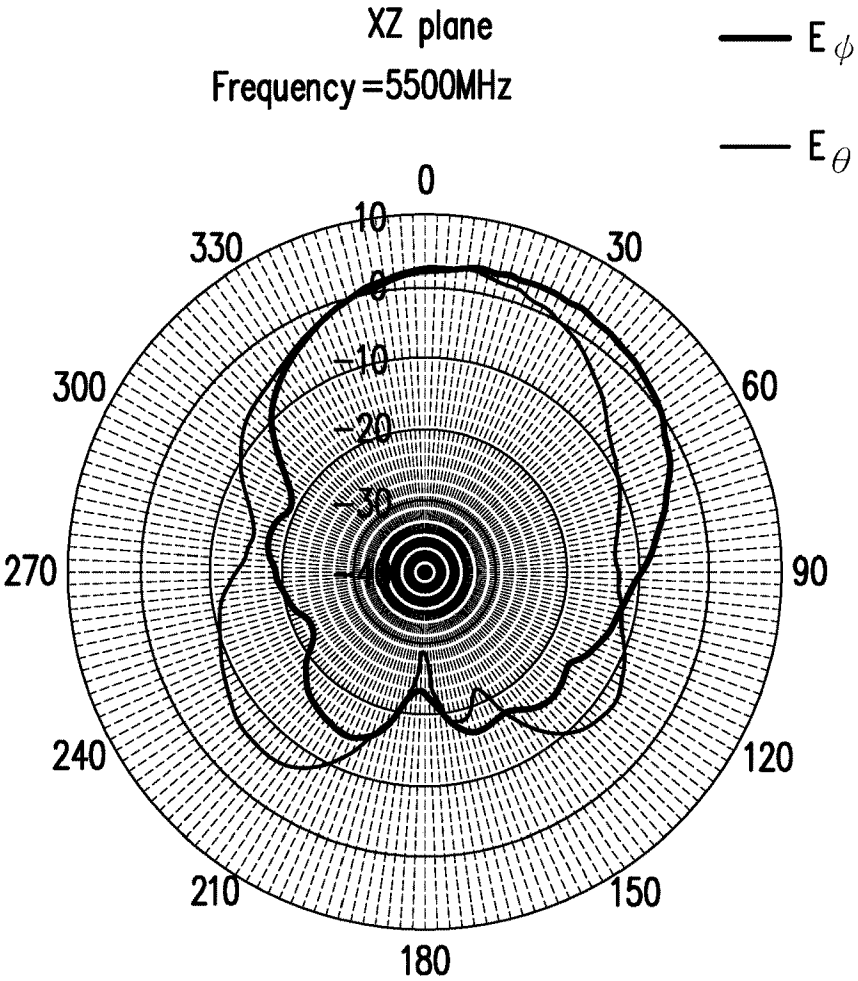

FIG. 17A and FIG. 17B are phi-axis electric field component $E_\Psi$ and theta-axis electric field component $E_\theta$ pattern diagrams on the XZ plane (Phi=0) and on the YZ plane (Phi=90) of the dual-band circularly polarized antenna structure of FIG. 10 at a frequency of 2450 MHz. FIG. 17C and FIG. 17D are $E_\Psi$ and $E_\theta$ pattern diagrams on the XZ plane and on the YZ plane of the dual-band circularly polarized antenna structure of FIG. 10 at a frequency of 5500 MHz. Referring to FIG. 17A to 17D, the dual-band circularly polarized antenna structure 100*b* of the embodiment, at frequency bands of a low frequency (i.e., 2.4 GHz) and a high frequency (i.e., 5 GHz), has $E_\Psi$ and $E_\theta$ of maximum energy at an angle of 0, and $E_\Psi$ and $E_\theta$ overlap for not more than 3 dB at the angle of 0; that is, the dual-band circularly polarized antenna structure 100*b* of the embodiment has a circular polarization characteristic on the XZ plane and the YZ plane and can simultaneously transmit or receive signals.

Figure 18:
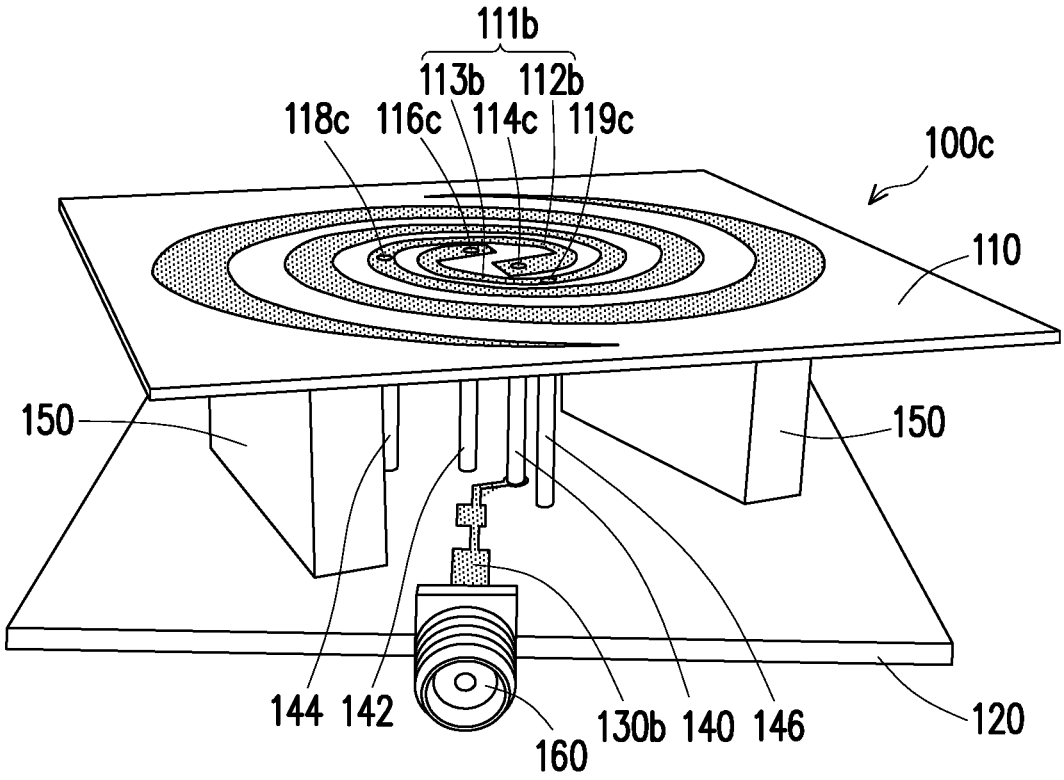
FIG. 18 is a schematic view of a dual-band circularly polarized antenna structure according to another embodiment of the disclosure.
Figure 19:
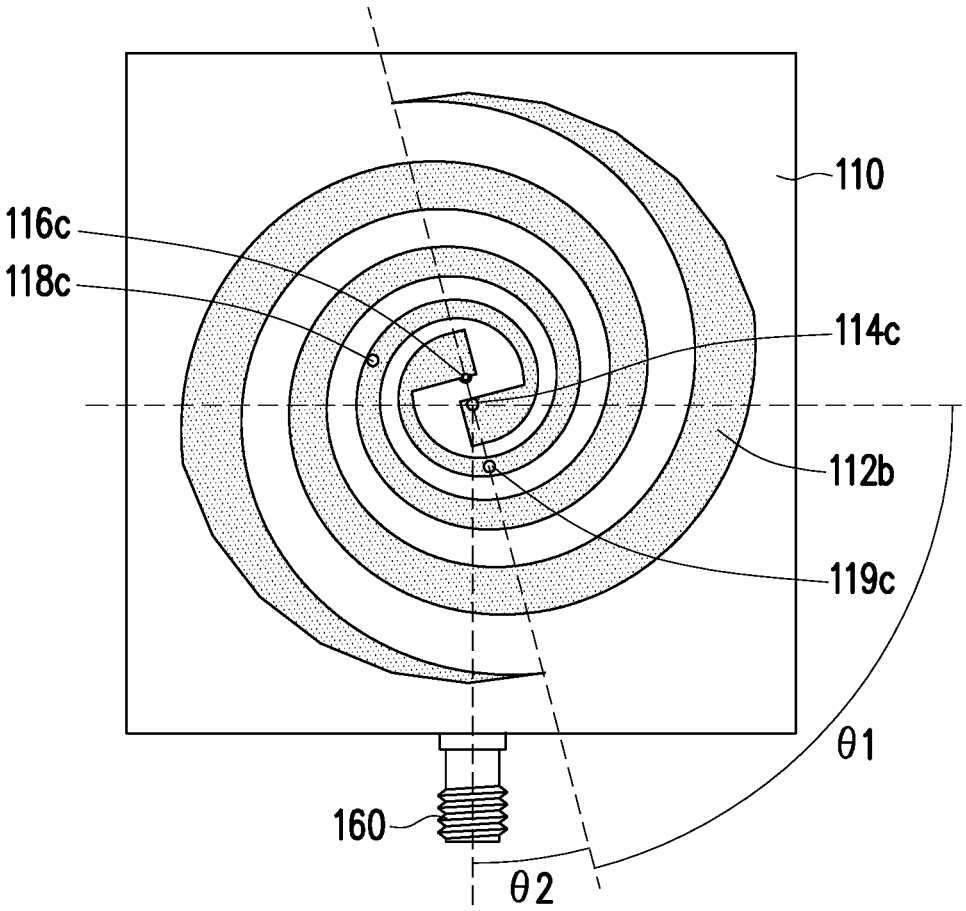
FIG. 19 is a schematic top view of a first substrate of the dual-band circularly polarized antenna structure of FIG. 18.

FIG. 18 is a schematic view of a dual-band circularly polarized antenna structure according to another embodiment of the disclosure. FIG. 19 is a schematic top view of a first substrate of the dual-band circularly polarized antenna structure of FIG. 18. Referring to FIG. 18 and FIG. 19, the dual-band circularly polarized antenna structure 100*c* of FIG. 18 is different from the dual-band circularly polarized antenna structure 100*b* of FIG. 10 mainly in that, in FIG. 10, the line connecting the feed-in portion 114*b* and the first grounding portion 116*b* is perpendicular to the extending direction of the microstrip line 130*b*. If the dual-band circularly polarized antenna structure 100*b* of FIG. 10 rotates the entire antenna unit 111*b* by an angle θ1 (indicated in FIG. 19) with the feed-in portion 114*b* as the center, in which the angle θ1 is between 70 degrees and 80 degrees and is, for example, 75 degrees, then it becomes the dual-band circularly polarized antenna structure 100*c* shown in FIG. 18.

In the embodiment, an angle θ2 (indicated in FIG. 19) between the line connecting the feed-in portion 114*c* and the first grounding portion 116*c* and the extending direction of the microstrip line 130*b* is between 10 degrees and 20 degrees (for example, 15 degrees) to improve the axial ratio characteristic on the XZ plane and the YZ plane of the dual-band circularly polarized antenna structure 100*c* at high frequencies.

Figure 20:
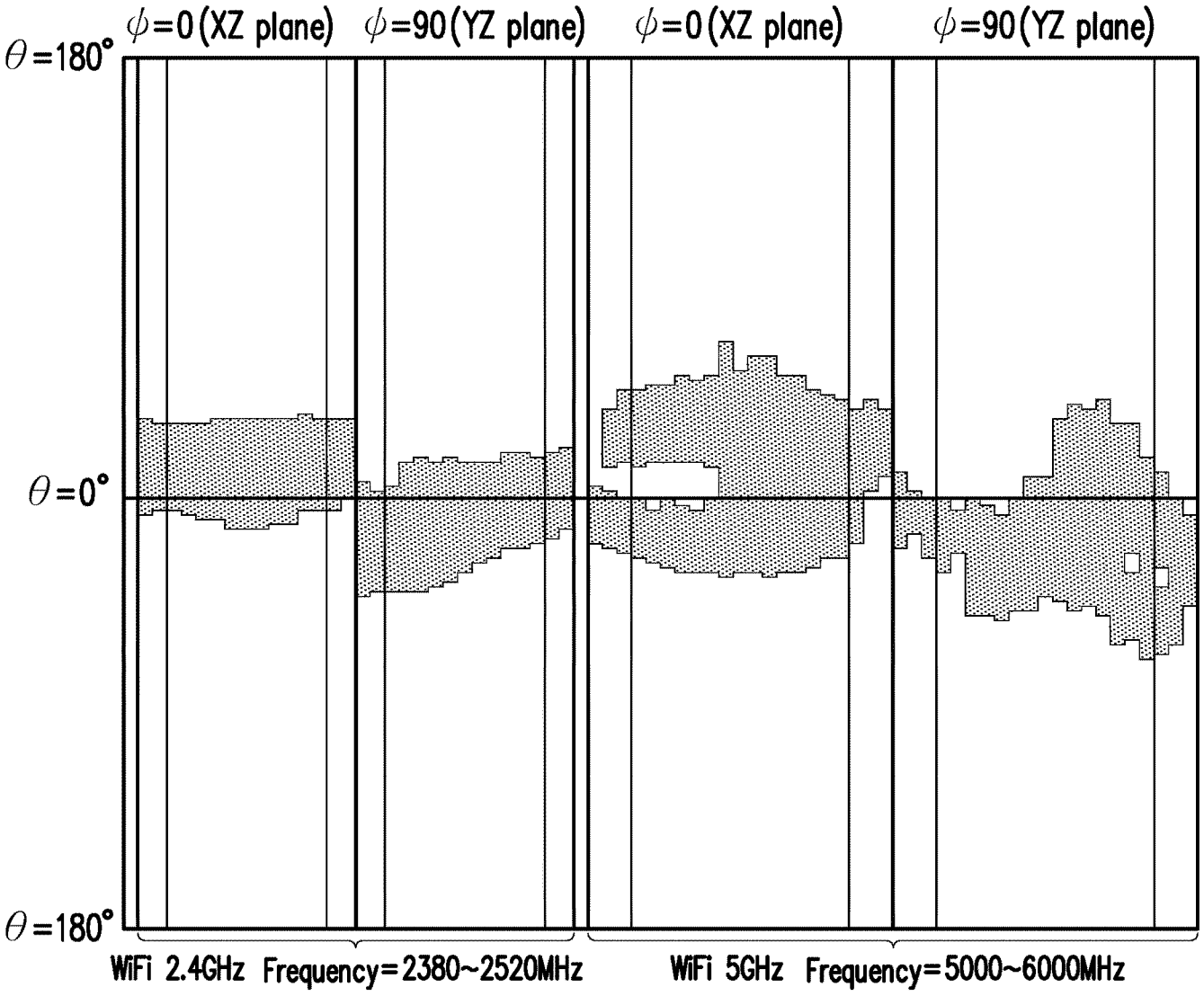
FIG. 20 is a frequency-axial ratio pattern distribution schematic diagram of the dual-band circularly polarized antenna structure of FIG. 18.

FIG. 20 is a frequency-axial ratio pattern distribution schematic diagram of the dual-band circularly polarized antenna structure of FIG. 18. It should be noted that in FIG. 20, only the area where the axial ratio is less than 3 dB is shown, and the area where the axial ratio is less than 3 dB is indicated by the dotted area. Referring to FIG. 20, the dual-band circularly polarized antenna structure 100*c* of the embodiment, at frequency bands of a low frequency (i.e., 2.4 GHz) and a high frequency (i.e., 5 GHz), has an axial ratio on the XZ plane and on the YZ plane of less than 3 dB where θ is 0 (that is, the Z-direction, the directly upward direction), and thus has good performance.

In summary, the antenna unit of the dual-band circularly polarized antenna structure of the disclosure form two spiral patterns by the first radiator and the second radiator spiraling outwardly around each other respectively from the portions near the feed-in portion and the first grounding portion as the two starting points, and the feed-in portion is coupled to the microstrip line below the antenna unit, such that the dual-band circularly polarized antenna structure of the disclosure can provide broadband dual frequency bands. Furthermore, the above design can allow the length and the width of the antenna unit not to be too large, and therefore, the dual-band circularly polarized antenna structure of the disclosure has a small volume.

Although the disclosure has been described with reference to the above embodiments, they are not intended to limit the disclosure. It will be apparent to one of ordinary skill in the art that modifications to the described embodiments may be made without departing from the spirit and the scope of the disclosure. Accordingly, the scope of the disclosure will be defined by the attached claims and their equivalents and not by the above detailed descriptions.

What is claimed is:

1. A dual-band circularly polarized antenna structure, comprising:

an antenna unit disposed on a first substrate, the antenna unit comprising:

a first radiator having a feed-in portion and a first spiral pattern, wherein the first spiral pattern spirals outwardly from a starting point close to the feed-in portion; and a second radiator having a first grounding portion corresponding to a position of the feed-in portion, and a second spiral pattern, wherein the second spiral pattern spirals outwardly from a starting point close to the first grounding portion in a manner non-overlapping with the first spiral pattern, and one of the first radiator and the second radiator further has a second grounding portion;

a microstrip line disposed on a second substrate, wherein the second substrate is disposed in parallel with the first substrate and spaced apart by a distance, and the feed-in portion of the first radiator of the antenna unit is coupled to the microstrip line; and a ground disposed on the second substrate, wherein the second grounding portion and the first grounding portion are coupled to the ground.

2. The dual-band circularly polarized antenna structure according to claim 1, wherein the antenna unit is disposed on an upper surface of the first substrate, the microstrip line is disposed on one of an upper surface and a lower surface of the second substrate, and the ground is disposed on another one of the upper surface and the lower surface of the second substrate, wherein the upper surface of the second substrate is closer to the first substrate than the lower surface is.

3. The dual-band circularly polarized antenna structure according to claim 2, wherein the microstrip line comprises a first segment, a second segment, a third segment, and a fourth segment from a center to an edge of the second substrate, a width of the second segment and the fourth segment is greater than a width of the first segment and the third segment, and a length of the second segment is between 3 mm and 4 mm.

4. The dual-band circularly polarized antenna structure according to claim 1, wherein two rectangles are respectively formed from the two starting points of the first spiral pattern and the second spiral pattern extending toward a center of a line connecting the two starting points of the first spiral pattern and the second spiral pattern, the feed-in portion and the first grounding portion are respectively located on the two rectangles, a direction of a line connecting the two rectangles is perpendicular to an extending direction of the microstrip line, and the first radiator has the second grounding portion.

5. The dual-band circularly polarized antenna structure according to claim 1, wherein two rectangles are respectively formed from the two starting points of the first spiral pattern and the second spiral pattern extending toward a center of a line connecting the two starting points of the first spiral pattern and the second spiral pattern, the feed-in portion and the first grounding portion are respectively located on the two rectangles, a direction of a line connecting the two rectangles is parallel to an extending direction of the microstrip line, and the second radiator has the second grounding portion.

6. The dual-band circularly polarized antenna structure according to claim 4, wherein a width of each of the rectangles is between 1.5 mm and 2.5 mm, a length of each of the rectangles is between 3.5 mm and 5 mm, and a distance between the two rectangles is between 1.5 mm and 2.5 mm, wherein a width line of each of the rectangles is perpendicular to a line connecting the two starting points of the first spiral pattern and the second spiral pattern, and a length line of each of the rectangles is parallel to the line connecting the two starting points of the first spiral pattern and the second spiral pattern.

7. The dual-band circularly polarized antenna structure according to claim 5, wherein a width of each of the rectangles is between 1.5 mm and 2.5 mm, a length of each of the rectangles is between 3.5 mm and 5 mm, and a distance between the two rectangles is between 1.5 mm and 2.5 mm, wherein a width line of each of the rectangles is perpendicular to a line connecting the two starting points of the first spiral pattern and the second spiral pattern, and a length line of each of the rectangles is parallel to the line connecting the two starting points of the first spiral pattern and the second spiral pattern.

8. The dual-band circularly polarized antenna structure according to claim 1, wherein a distance between a center of a line connecting the two starting points of the first spiral pattern and the second spiral pattern and the feed-in portion is between 2 mm to 3 mm, a distance between the center and the first grounding portion is between 2 mm and 3 mm, and a distance between the center and the second grounding portion is between 6 mm and 8 mm.

9. The dual-band circularly polarized antenna structure according to claim 1, wherein a distance between the two starting points of the first spiral pattern and the second spiral pattern is between 8.5 mm and 12.5 mm, and a diameter of each of the first spiral pattern and the second spiral pattern is between 50 mm and 55 mm.

10. The dual-band circularly polarized antenna structure according to claim 1, wherein the feed-in portion, the first grounding portion, and the second grounding portion are arranged in a straight line.

11. The dual-band circularly polarized antenna structure according to claim 1, wherein the first radiator has the second grounding portion, the second grounding portion is located at a position rotated from the feed-in portion along the first radiator by 260 degrees, the second radiator further has a third grounding portion coupled to the ground, and the third grounding portion is located at a position rotated from the first grounding portion along the second radiator by 180 degrees.

12. The dual-band circularly polarized antenna structure according to claim 11, wherein the microstrip line has a first segment, a second segment, a third segment, and a fourth segment, a width of the second segment and the fourth segment is greater than a width of the first segment and the third segment, a length of the second segment is between 7 mm and 9 mm, and a length of the third segment is between 2 mm and 4 mm.

13. The dual-band circularly polarized antenna structure according to claim 11, wherein a line connecting the feed-in portion and the first grounding portion is perpendicular to an extending direction of the microstrip line.

14. The dual-band circularly polarized antenna structure according to claim 11, wherein an angle between a line connecting the feed-in portion and the first grounding portion and an extending direction of the microstrip line is between 10 degrees and 20 degrees.

* * * * *